United States Patent [19]

Suga

[11] Patent Number: 4,841,715

[45] Date of Patent: Jun. 27, 1989

[54] PACKAGING APPARATUS

[75] Inventor: Tadoru Suga, Ibaraki, Japan

[73] Assignee: Ibaraki Precision Machinery Co., Ltd., Osaka, Japan

[21] Appl. No.: 182,471

[22] Filed: Apr. 15, 1988

[51] Int. Cl.[4] ..... B65B 9/00; B65B 11/20

[52] U.S. Cl. ..... 53/547; 53/556; 53/210; 493/479

[58] Field of Search ..... 53/547, 556, 210, 222, 53/226; 493/479

[56] References Cited

U.S. PATENT DOCUMENTS

| | | | |
|---|---|---|---|
| 3,537,235 | 11/1970 | Pepmeer | 53/210 |
| 3,629,993 | 12/1971 | Chant, Jr. | 53/209 |
| 3,973,372 | 8/1976 | Omori | 53/222 X |
| 4,144,697 | 3/1979 | Suga | 53/547 X |
| 4,483,125 | 11/1984 | Suga | 53/547 X |
| 4,571,927 | 2/1986 | Suga | 53/556 X |

*Primary Examiner*—John Sipos
*Attorney, Agent, or Firm*—Joseph W. Farley

[57] ABSTRACT

The invention relates to a packaging apparatus designed so that a belt-like plastic film is placed over articles being transported on a conveyor, the article being wrapped in the film while the film being stretched widthwise, the film being cut between adjacent articles, the cut ends of the film being folded to and brought in adhesion to the underside of the article. A pair of chains run on both sides of a path of transport of the articles, each of the chains having a number of clamps. As the chains run, the clamps place the film over the articles while clamping both side edge portions and pulling them in the widthwise direction. The distance between the chains is adjustable; where a stretchable film having a high draw ratio is used, the interchain distance is broadened, whereas in the case of a heat-shrinkable film having a low draw ratio being used, the interchain distance is narrowed.

6 Claims, 5 Drawing Sheets

PACKAGING APPARATUS

FIELD OF THE INVENTION

The present invention relates to a packaging apparatus designed so that a belt-like plastic film sheet is placed from above onto a plurality of articles to be packaged for covering them as they are transported on a conveyor on which they are loaded in equally spaced apart relation, said film sheet being folded at both sides thereof to the underside of said articles while being stretched in its widthwise direction, being thereby formed into a tubular shape, and so that the tube of the film is cut between each successive two of the articles, both ends of each cut tube being folded to the underside of the article enclosed in the tube, the folded film ends being then thermowelded to the underside of the tube enclosing the article.

In order that both ends of the cut tubular film folded onto the underside of each article being packaged may be satisfactorily thermowelded on the underside of the tube in which the article is contained, it is essential that the bottom of the article must be flat. Therefore, it is a usual practice to place the article to be packaged in a tray having a flat bottom and wrap the tray with a film material.

The function of the packaging apparatus in accordance with the present invention when it is in operation for packaging articles into a packaged form is schematically explained with reference to some of the accompanying drawings. As shown in FIG. 11, a belt-like film F is put over a tray A in which an article D is placed and then the film F is folded at its side edge portions $F_1$, $F_2$ to the underside of the tray A while it is stretched widthwise on both sides thereof so that the film F is formed into a tubular shape. Then, the tubular film F is cut to a predetermined length, and both ends $F_3$, $F_4$ of the cut film are pulled downward by a vacuum force of suction as can be seen from FIG. 12. Further, as illustrated in FIG. 13, as the tray A is transported in the direction of arrow E while one end $F_3$ of the film is brought in contact with a vertical wall plate B, the one film end $F_3$ is held in taut condition through its frictional contact with the wall plate B so that it is folded to the underside of the tray A. The other end $F_4$ of the film is folded in taut condition to the underside of the tray A at the rear side thereof by a roller C which runs at a velocity higher than that at which the tray A is transported, as shown in FIG. 14. By being tautened in this way the film F is caused to give a transparency effect.

BACKGROUND ART

However, the packaging means illustrated in FIGS. 11 to 14 are not novel because they are disclosed in U.S. Pat. No. 3,973,372, U.S. Pat. No. 4,144,697, U.S. Pat. No. 4,483,125, and U.S. Pat. No. 4,571,927. The packaging apparatus described in any of these publications includes a supply conveyor centrally disposed for transporting thereon articles to be packaged, and a pair of chain conveyors disposed on both sides of the supply conveyor for transporting a film material while supporting opposite edge portions thereof. A multiplicity of articles to be packaged are transported at equispaced intervals on the supply conveyor, and the film is transported at same speed as the articles while it is supported at its opposite edge portions by the chain conveyors, so that the film is successively placed over the articles. In this connection it is noted that the chain conveyors have a downward slope extending along the path of travel of the individual articles so that the film is fed so as to gradually go into contact with the articles from an oblique direction; therefore, the film is placed from above over the articles and simultaneously stretched laterally. Beyond the chain conveyors and along the path of travel of the articles being packaged there are provided a pair of side belts for transporting the articles by holding them therebetween. Beyond the supply conveyor there is disposed a device for folding both side edge portions of the film to the underside of the articles as the film is released from the chain conveyors. Therefore, the film is wrapped in a tube form around the articles. At a further downstream location in the path of travel of the articles, the tube-form film is cut by a cutting device between each two adjacent ones of the articles. Under the path of travel of the articles carried between the side belts, there are provided air suction channels, by which the cut ends of the film are pulled downward. Each two cut ends of the film are folded to the underside of the corresponding article by both the force of movement of the article and the action of a rod-like element which runs at a greater speed than that of the article. The two film ends so folded to the underside of the article are thermowelded to the film tube in which the article is enclosed as the article is transferred on a heated belt conveyor.

Aforesaid known packaging apparatuses were developed with a view to enabling the packaging of articles to be performed with the effect of clearness by covering the articles with a stretchable film sheet while stretching the film sheet by mechanical force, then removing wrinkles present on the film. However, it has been found possible to provide the effect of film clearness by packaging articles with a heat-shrinkable film sheet while subjecting the film to shrinkage by heating. On the basis of this finding the present inventor made attempts to use both a stretchable film material and a heat-shrinkable film material with such known packaging apparatus. However, since a heat-shrinkable film material is substantially less stretchable, needs have arisen for improvement of such packaging apparatus for enabling the use with it of said two types of film materials having different properties.

DISCLOSURE OF THE INVENTION

Accordingly, it is an object of the invention to provide a packaging apparatus which can be employed with various types of film materials having different degrees of stretchability.

It is another object of the invention to provide a packaging apparatus designed so that a film sheet stretched by a pair of chain conveyors disposed on both sides thereof is prevented from being elastically shrunk instantly when it is released from the chain conveyors, so that the film is placed over the articles being packaged while it is kept in taut condition.

It is a further object of the invention to provide a packaging apparatus designed so that the ends of the film folded to the underside of the article being packaged are prevented from being separated from the underside of the article by a difference in running speed between a rod-shaped element for folding the ends of the film to the underside of the article and a heated belt conveyor located beyond the rod-shaped element for thermowelding the film ends to the underside of the article.

In order to accomplish these objects, the apparatus for packaging articles with a plastic film sheet according to the invention comprises:

means for transporting a plurality of articles at equispaced intervals, means for placing over said articles a belt-like plastic film payed out from a position above a transport path of said transporting means and at the upstream side of said path while causing the plastic film to be stretched in the widthwise direction thereof, means for folding to the underside of the articles both side edge portions of the film placed over said articles, thereby forming the film into a tube shape so that the articles are enclosed in said tube of the film, means for cutting said tube of the film between each two adjacent ones of the articles aligned in the direction of travel thereof, folding the leading and trailing ends of each cut tube of the film toward the underside of the corresponding article, then bringing the folded film ends into adhesion to the film portion covering the underside of the article, said means for placing the film over the articles comprising a pair of endless chain means disposed on both sides of said transport path of said transporting means and driven to run along said transport path, each of said pair of chain means including a plurality of clamps for sequentially clamping the side edge of said film at a starting end portion of the chain means and sequentially releasing said side edge at a terminal end portion of the chain means, said pair of chain means being downwardly inclined from a position at a higher level than the upstream-side portion of said transport path of said transporting means and toward a position at a lower level than the downstream-side portion of said transport path so that the film can be placed over the articles being packaged while it is carried along said inclined path, said pair of chain means being adapted to move gradually away from each other at the starting end side of said inclined path of travel while moving along said path so that the film can be stretched widthwise before it is brought in contact with the articles being packaged, and said pair of chain means being adapted to move gradually toward each other at the terminal end side of said inclined path while moving along said path so that both side edges of the film placed over the articles can be brought toward each other at a level lower than the articles for being guided to said folding means, and said pair of chain means being adjustable for changing the angle of inclination thereof.

According to the foregoing arrangement, in the case where articles are to be packaged by using a stretchable film having a high draw ratio, the pair of chain means is inclined to a high degree, whereby the film placed centrally over the articles on the transport path is pulled by the chain means considerably downward at both side edge portions thereof to a level below the transport path so that the film is sufficiently stretched. On the other hand, in the case where a heat-shrinkable film having an insignificant degree of stretching is used, the degree of inclination of the chain means can be reduced so that the pull of side edge portions of the film toward a level below the transport path is limited to a moderate degree, the film being thus prevented from being excessively stretched. Through such arrangement it is possible to provide a packaging apparatus which can be employed with various types of film materials having different draw ratios.

DESCRIPTION OF THE PREFERRED EMBODIMENT

Figure 3:
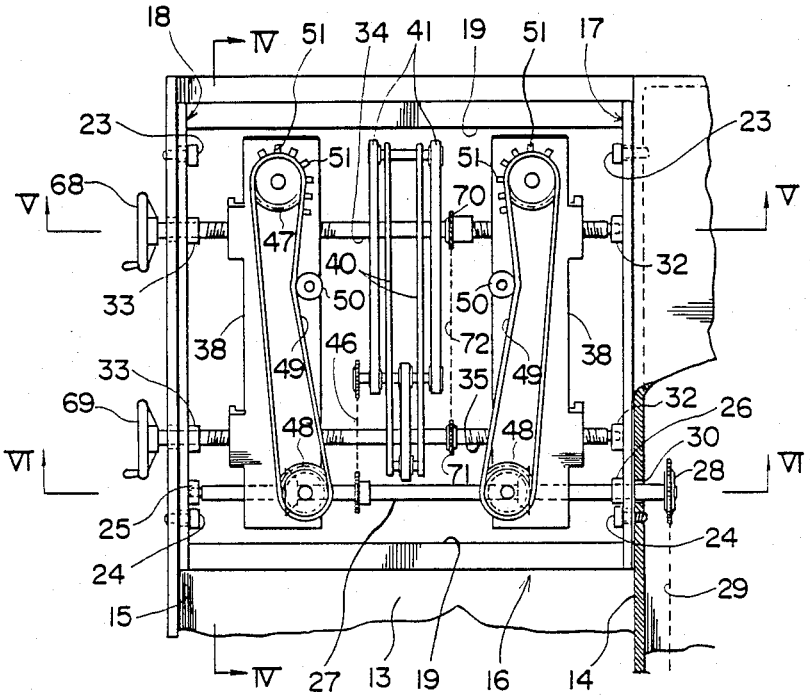
FIG. 3 is a plan view showing a chain conveyor arrangement for stretching the film in both sidewise directions.
Figure 4:
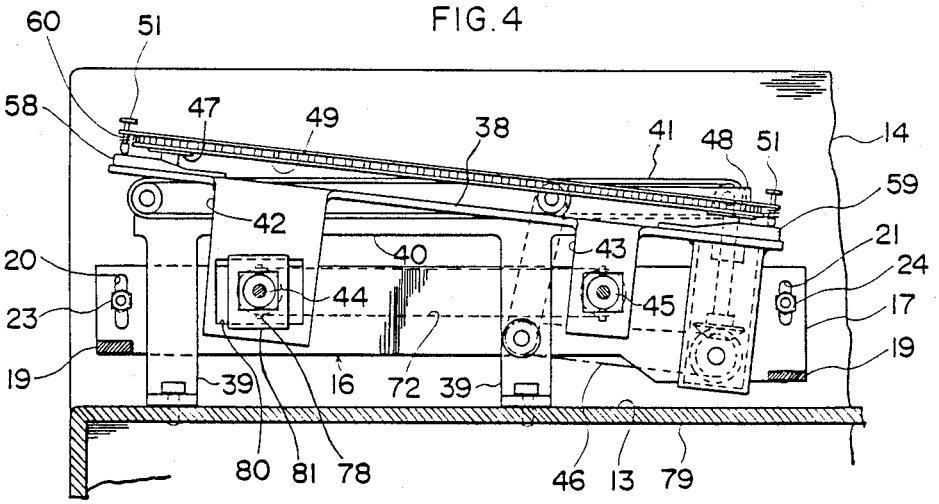
FIG. 4 is a section taken on the line IV—IV in FIG. 3.

As shown in FIG. 3, the packaging apparatus of the invention includes a machine frame having a box—shape portion consisting essentially of a horizontal base plate 13 and two walls 14, 15 erected upright thereon, a movable frame structure 16 being fitted in the box-shape portion. The frame structure 16 consists of two opposite side plates 17, 18 and stays 19, 19 connecting respective both ends of the side plates 17, 18. As shown in FIG. 4, the side plates 17, 18 each has vertically elongate holes 20, 21 bored therein at opposite ends thereof respectively, bolts 23, 23, 24, 24 being threadedly fitted into the walls 14, 15 of the machine frame through the elongate holes 20, 21 so that the frame structure 16 is fixed to the machine frame. It may be understood that the frame structure 16 can be suitably inclined by moving same up and down at the opposite ends thereof within the length limits of the elongate holes 20, 21. A drive shaft 27 is supported in bearings 25, 26 fixed respectively on the inner surfaces of the two side plates 17, 18 of the frame structure 16. The drive shaft 27 extends at one end through the one wall 14 of the machine frame, said one end of the drive shaft 27 being connected through a chain wheel 28 to a chain 29 so that power is conducted from the chain 29 to the drive shaft 27. A hole 30 through which the drive shaft 27 extends is vertically elongate (see FIG. 6), and therefore the frame structure 16 may be moved up and down without any inconvenience being involved in connection with the conduction of power to the drive shaft 27.

Figure 5:
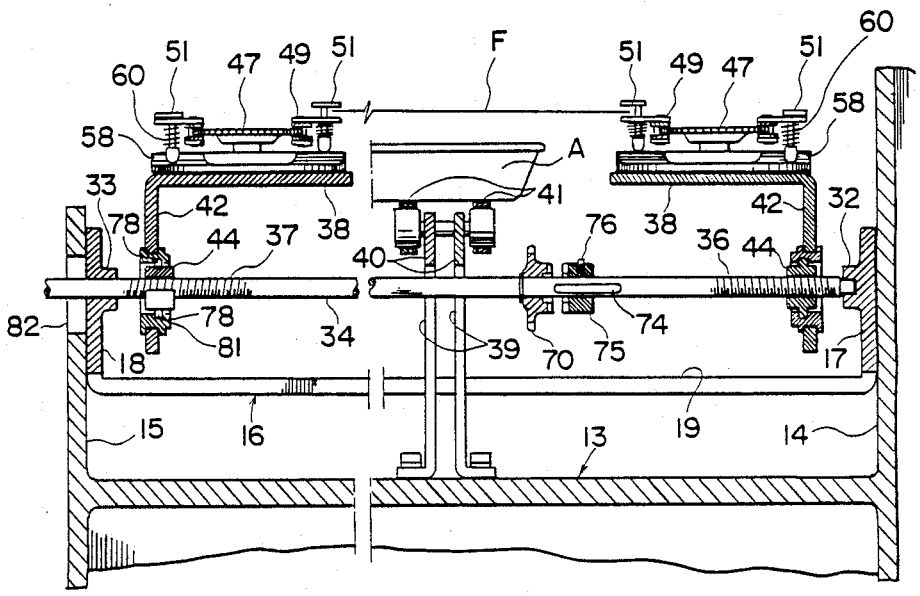
FIG. 5 is a section taken on the line V—V in FIG. 3.

On the respective inner sides of the two side plates 17, 18 of the frame structure 16 there are disposed bearings 32, 32; 33, 33, two for each side; and two screw rods 34, 35, front and rear, are rotatably supported respectively in said two sets of bearings 32, 32, 33, 33. As shown in FIG. 5, the screw rods 34, 35, each has a right-hand thread 36 and a left-hand thread 37 at locations adjacent its opposite ends respectively, a pair of elongate seating plates 38, 38 being supported in parallel relation between the two screw rods 34, 35. More specifically, a belt-type supply conveyor 41 is disposed on a frame 40 mounted centrally on the base plate 13 of the machine frame through legs 39, said two seating plates 38, 38 being disposed on both sides of the supply conveyor 41, support plates 42, 43 extending downward respectively from front and rear side edges of each seating plate 38 in perpendicular relation thereto, as shown in FIG. 4, said support plates 42, 43 being in engagement with the right-hand threads 36 and left-hand threads 37 of the screw rods 34, 35 through nuts 44, 45. The supply conveyor 41, connected to the drive shaft 27 through the chain 46, carries articles A thereon for transport of same. The two seating plates 38, 38 are so disposed as to be moved downward at a moderate degree of inclination and along the path of travel of the articles A, and as shown in FIG. 3, on each of the two seating plates 38, 38 and at opposite ends thereof there are disposed two chain wheels 47, 48; 47, 48 over which an endless chain 49; 49 is entrained; two sets of said chain wheels 47, 48, 47, 48 and endless chain 49, 49 constitute a pair of chain conveyors, right and left. The respective inner sides of the two chains 49, 49 are outwardly jutted by means of tension wheels 50, 50 so that the distance between midportions of the chain conveyors is enlarged. Further, each of the chains has a multiplicity of clamps 51, 51 provided thereon at equal intervals.

Figure 1:
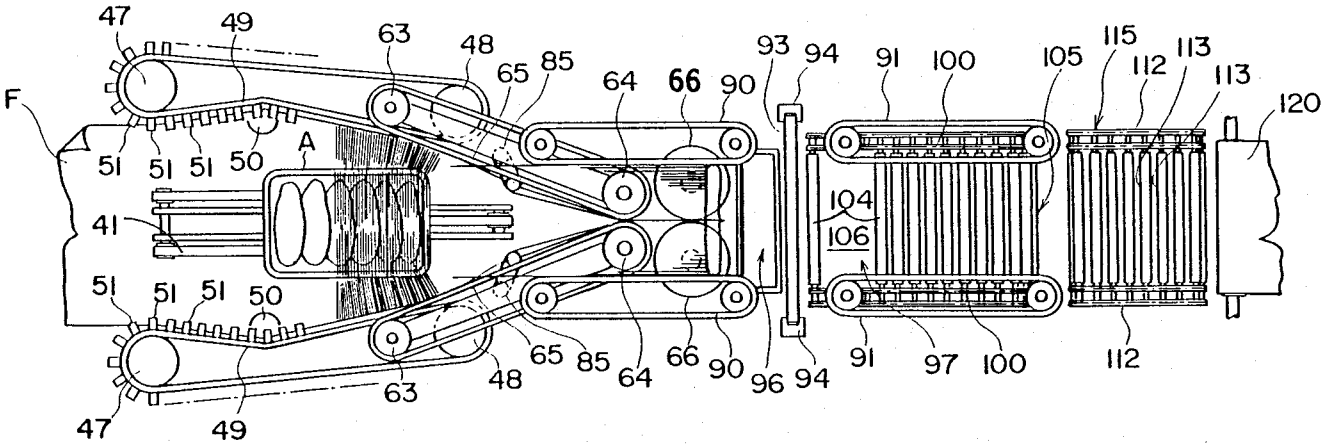
FIG. 1 is a plan view showing general arrangement of a packaging apparatus embodying the present invention.
Figure 2:
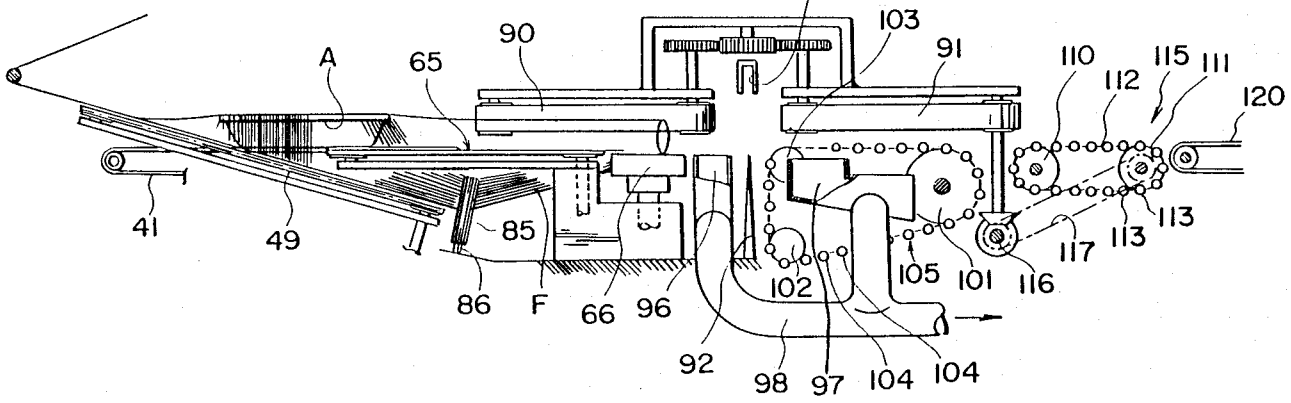
FIG. 2 is a side view of the packaging apparatus in FIG. 1.
Figure 6:
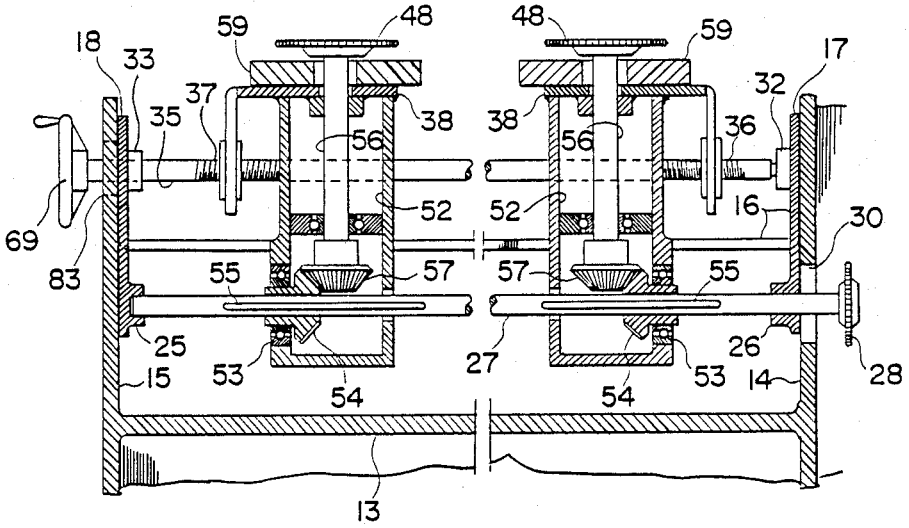
FIG. 6 is a section taken on the line VI—VI in FIG. 3.
Figure 7:
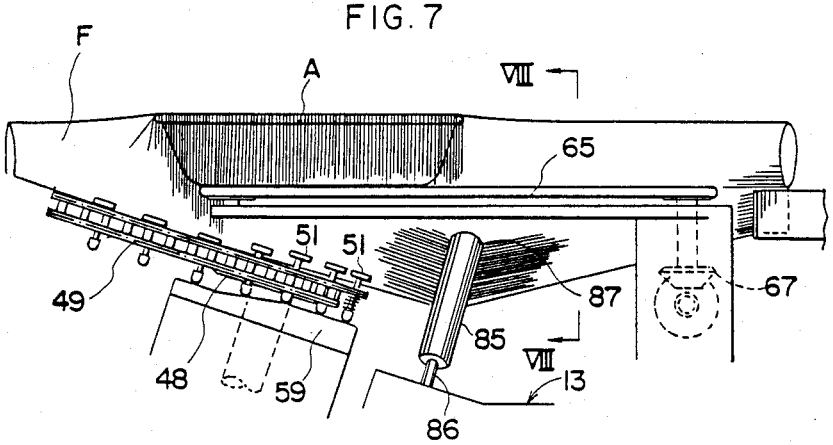
FIG. 7 is a side view showing an arrangement for folding both side edge portions of a film sheet to the underside of the articles being packaged.

As shown in FIG. 6, there are provided gear boxes 52, 52 each extending downward from and in perpendicular relation to the underside of both of the two seating plates 38, 38 to the position of the drive shaft 27, first bevel gears 54, 54 each being supported on one side of one or the other of the gear boxes 52, 52 through a ball bearing 53. The first bevel gears 54, 54 are connected to the drive shaft 27 through slide keys 55, 55, and they are respectively in engagement with second bevel gears 57, 57 fixed respectively to shafts 56, 56 of the chain wheels 48, 48. Accordingly, the power from the drive shaft 27 is transmitted to the chain wheels 48, 48 through the bevel gears 54, 54, 57, 57 so that the chains 49, 49 in FIG. 3 are driven to run. Further, as shown in FIG. 4, cams 58, 59 are provided on each seating plate 38 and under the front and rear chain wheels 47, 48 so that the clamps 51 which are normally in closed condition under the tension of springs 60 are made open as they go in contact with the cams 58, 59. Accordingly, as shown in FIG. 1, both side edge portions of the film F are clamped sequentially by the multiplicity of clamps 51, 51 . . . , being transported through the movement of the chains 49, 49. Since the distance between the midportions of the chains 49, 49 is enlarged by means of the tension wheels 50, 50, the film F is stretched widthwise toward this enlarged portion. Through the downward inclination of the chains 49 as shown in FIG. 2, the film F is placed over the articles A being transported on the supply conveyor 41. Above the chain conveyors on the downstream side thereof there are provided a pair of running belts 65, 65 supported by two wheels 63, 64 and V-configured so that they are progressively narrowed. As shown in FIG. 7, both side edge portions of the film F are folded to the underside of the articles A as driving power is transmitted to the belts 65, 65 through a wheel 67, and the both side edge portions of the film F are thermowelded together at their overlapping portion so that the film F is formed into a tubular shape so as to wrap the articles A therein.

As shown in FIG. 3, each of the two screw rods 34, 35 extends outward at its one end through the wall 15 of the machine frame, handles 68, 69 being fixed respectively to said ends of the screw rods 34, 35. Chain wheels 70, 71 provided respectively on the screw rods 34, 35 are connected by a chain 72. Thus, the two screw rods 34, 35 are simultaneously rotated by the chain 72 when one of the handles 68, 69 is manipulated. When the two screw rods 34, 35 are simultaneously rotated in this way, by the action of the right-hand and left-hand threads 36, 37 cut on the screw rods 34, 35, the pair of seating plates 38, 38 are moved toward or away from each other while being kept in parallel relation, the distance between the pair of chains 49, 49 being thus adjusted. When the width of the film F is varied according to changes in the sectional area of the articles A to be packaged, it is necessary to adjust the distance between the chains 49, 49 in this way.

As shown in FIG. 5, the chain wheel 70 is rotatably provided on the one screw rod 34, a clutch 75 being mounted to the screw rod 34 through a slide key 74. When the clutch 75 is brought in engagement with the chain wheel 70, the chain wheel 70 is fixed to the screw rod 34 through the key 74. If a machine screw 76 is loosened to release the clutch 75 from the chain wheel 70, the two screw rods 34, 35 are disconnected from each other, and accordingly the rear screw rod 35 can be independently rotated to freely adjust the distance between the rear ends of the seating plates 38, 38 while the distance between the front ends of the plates 38, 38 being kept as it is. When such adjustment is made, the parallel relation of the seating plates 38, 38 is lost; therefore, as shown in FIG. 4, the nuts 44, 45 are rotatably supported by vertical pins 78, 79 respectively, and the frontside nut 44 in particular is supported by a slider 81 provided on a guide 80 for the support plate 42.

The reason why the distance between the rear ends of the pair of seating plates 38, 38 and that between the rear ends of the chains 49, 49 are made adjustable in this way is that a stretchable film and a heat-shrinkable film are different in draw ratio. Where a heat-shrinkable film is used, the distance between the rear ends of the chains 49, 49 is narrowed to limit the degree of stretch of the film, and conversely, where a stretchable film is used, the distance between the rear ends of the chains 49, 49 is increased. At same time, the bolts 23, 23, 24, 24 are loosened to move the front and rear ends of the frame structure 16 upward and downward so that where a heat-shrinkable film is used, the degree of inclination of the chains 49, 49 is reduced and the pressing force of the film against the articles is lowered, while on the other hand, where a stretchable film is used, the chains 49, 49 are inclined more sharply, the pressing force of the film against the articles being thereby adjusted to a larger degree. Since a heat-shrinkable film is considerably low in stretchability as compared with a stretchable film and is liable to breakage when it is pressed against the articles under considerable force, such adjustment is necessary. Such adjustment is made possible by this invention, and accordingly it is now possible to commonly use aforesaid two types of films in packaging operation. In addition, as shown in FIGS. 5 and 6, holes 82, 83 provided in the wall 15 through which the screw rods 34, 35 extend respectively are vertically elongated so that the inclination of the frame structure 16 can be easily and conveniently adjusted in vertical directions.

Figure 8:
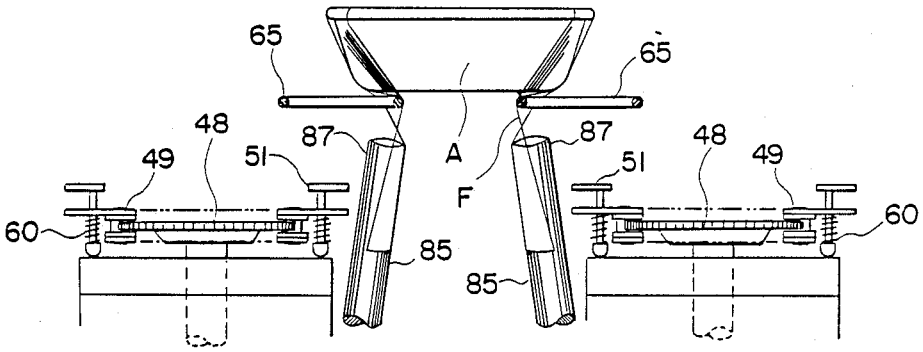
FIG. 8 is a section taken on the line VIII—VIII in FIG. 7.

As shown in FIGS. 7 and 8, at a location beyond the chains 49 there are provided a pair of upwardly extending rollers 85, 85, each of which rollers is rotatably supported at its one end on the machine frame 13 through a shaft 86. These rollers 85, 85 are inclined so that their upper ends 87, 87 are positioned closer to each other and so that the upper ends 87, 87 are inclined in the direction of travel of the articles A so that the axes of the rollers 87, 87 are generally orthogonal to the direction of inclination of the chains 49. The surfaces of the rollers 85, 85 are such that their rough surfaces have been smoothly finished by, for example, chrome plating, to provide increased force of friction relative to the film F so as to permit the film F to go into close contact with the rollers 85, 85. Therefore, the both side edge portions of the film F stretched by the chains 49 are guided while being held in contact with the rollers 85, 85, without being elastically shrunk, instantly when they are released from the clamps 51, and accordingly the both side edge portions can be folded to the underside of the articles A by the pair of running belts 65, 65 so that the film F can be formed into a tube shape for enclosing the articles A therein. Thus, the film F can have good transparency effect.

As shown in FIG. 1, beyond the mechanism for placing the film F in a tubular form over the articles A, there are provided successive sets of side belts 90, 90, 91, 91, on both sides. These side belts 90, 90, 91, 91, respectively supported by pulleys, run at same speed as the running belts 65, 65 which fold the side edge portions $F_1$, $F_2$ of the film F to the underside of the articles A, and the articles A wrapped in the film F are transported while being held between the side belts 90, 90, 91, 91. As shown in FIG. 2, in a gap between the longitudinally aligned side belts 90, 91 and at a lower level there is provided a cutter blade 92, a groove-shaped press cutting member 93 being disposed above the blade 92. The press cutting member 93 repeatedly moves up and down in good timing adjusted to the process of transport of the articles A. As the press cutting member 93 moves down toward the cutter blade 92 and along the guides 94, 94, the tubular film F is cut between two adjacent articles A. At both sides of the cutter blade 92 as seen in the longitudinal direction of the path of transport there are disposed air suction holes 96, 97 opening upward, which are connected to a vacuum pump through a duct 98. Cut ends of the film F are sucked into the air suction holes 96, 97 under a suction force. The leading end of the film F being pulled into the upstream side suction hole 96 is brought in contact with the wall of the suction hole 96 and folded to the underside of the article A as the article A is moved forward while being held between the side belts 90.

Figure 9:
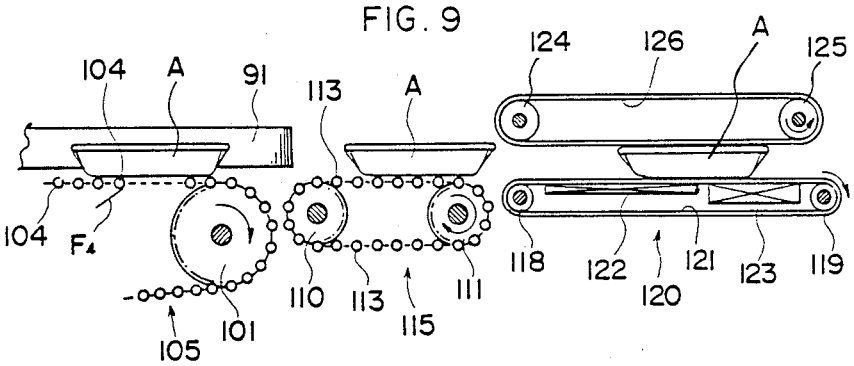
FIG. 9 is an explanatory view showing a belt conveyor for thermowelding film ends to the underside of each of the articles being packaged and an adjacent arrangement.
Figure 14:
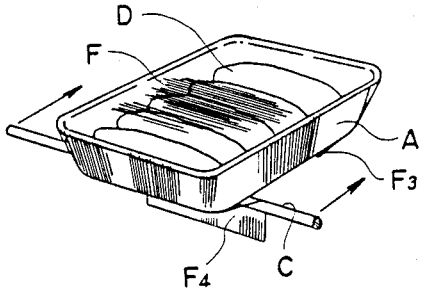

On both sides of the downstream side suction hole 97 there are disposed chains 100, 100 trained over chain wheels 101, 102, 103, and a multiplicity of idle rollers 104, 104 are disposed between these chains 100, 100 and around the suction hole 97; they altogether constitute an intermittent running belt 105. This intermittent running belt 105 has one large gap 106 defined between two adjacent idle rollers 104, 104, which gap 106 is usually positioned without movement above the opening of the air suction hole 97. Accordingly, the trailing end of the film F on the article A held between the side belts 91, 91 is sucked into the suction hole 97 through the gap 106. As the end of the film F is sucked into the suction hole 97, the intermittent running belt 105 begins to run at higher speed than the side belts 91, and accordingly, as shown in FIG. 9, film end $F_4$ is caught by the idle rollers 104 and then folded to the underside of the article A being transported by the side belts 91 (see FIG. 14). The film F has self adhesive properties, though insignificant, and therefore the both ends $F_3$, $F_4$ of the film folded onto the underside of the article A are carried forward as they are part of the tubular film F wrapped around the article A.

Figure 10:
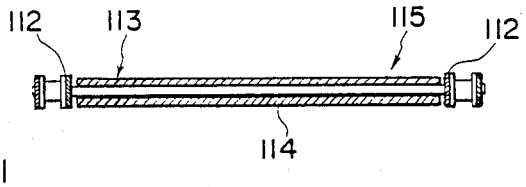
FIG. 10 is a sectional view showing a roller portion of the transfer conveyor in FIG. 9.
Figure 11:
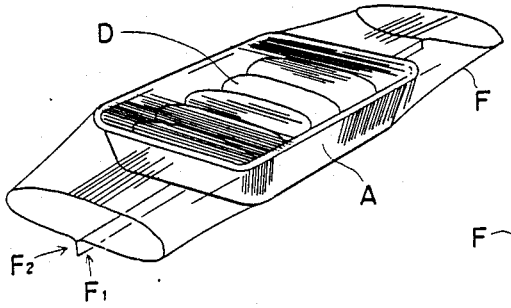
FIG. 11 through 14, inclusive, are views illustrating the working sequence of packaging.
Figure 12:
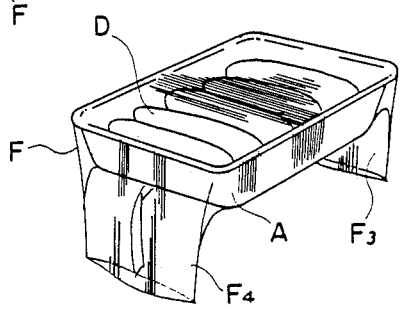
Figure 13:
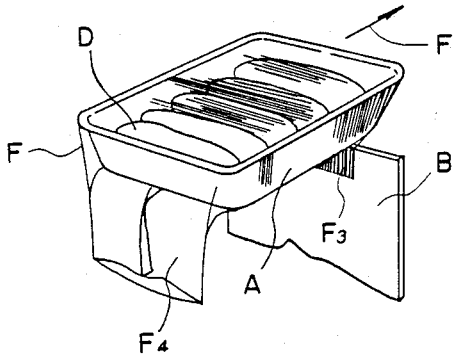

In succession to the intermittent running belt 105, there is disposed a transfer conveyor 115 having a multiplicity of idle rollers 113, 113 mounted thereon between a pair of chains 112, 112 supported on chain wheels 110, 111. Each of the rollers 113, as shown in FIG. 10, consists of a pipe 113 rotatably fitted on the outer periphery of a shaft rod 114 mounted between chains 112, 112. As shown in FIG. 2, a second drive shaft 116 for driving the side belts 91 is connected to the transfer conveyor 115 through a chain 117, whereby the speed of movement of the article A transported while being held between the side belts 91 is in agreement with the running speed of the transfer conveyor 115. As shown in FIG. 9, a belt conveyor 120 trained on pulleys 118, 119 is disposed beyond the transfer conveyor 115, and a heater 122 and a cooling element 123 are disposed on the underside of the top surface of the conveyor belt 121, there being disposed a presser belt 126 trained on pulleys 124, 125 above the belt conveyor 120.

In a packaging apparatus of the type, the final belt conveyor 120 is normally driven by an independent motor to rotate at constant speed, since the temperature of the heater 122 is constant at all times. However, the running speed of the mechanism for transporting the film F is varied according to the length of the article A to be packaged, and accordingly the running speed of the side belts 91 is varied integrally with the film transport mechanism. Therefore, in prior packaging apparatus in which no transfer conveyor 115 is present, some degree of slip is caused between the underside of the article A and the belt conveyor 120 because of the difference in speed between the side belts 91 and the belt conveyor 120 when the article A is transferred from the side belts 91 to the belt conveyor 120, it being thus often likely that the film ends $F_3$, $F_4$ folded to the underside of the article A will come off under the force of friction. However, by virtue of the presence of the transfer conveyor 115, the rollers 113, 113 rotate freely when the article A is transferred from the transfer conveyor 115 to the belt conveyor 120, and therefore possible slide, if any, of the article A relative to the belt conveyor 120 is insignificant, the film F being thus prevented from coming off the underside of the article A. Film ends $F_3$, $F_4$ are thermowelded to the underside of the article A by the belt 121 heated by the heater 122, and the welded part is subsequently cooled by the cooling element 123. The presser belt 126 disposed above the belt 121 is also heated by the heat from the heater 122; therefore, the heat shrinkable film F is shrunk through its contact with the belt 126.

What is claimed is:

1. A packaging apparatus for packaging articles with a plastic film sheet, comprising:

means for transporting a plurality of articles at equispaced intervals, means for placing over said articles a belt-like plastic film payed out from a position above a transport path of said transporting means and at the upstream side of said path while causing the plastic film to be stretched in the widthwise direction thereof, means for folding to the underside of the articles both side edge portions of the film placed over said articles, thereby forming the film into a tube shape so that the articles are enclosed in said tube of the film, means for cutting said tube of the film between each two adjacent ones of the articles aligned in the direction of travel thereof, folding the leading and trailing ends of each cut tube of the film toward the underside of the corresponding article, then bringing the folded film ends into adhesion to the film portion covering the underside of the article, said means for placing the film over the articles comprising:

a pair of endless chain means disposed on both sides of said transport path of said transporting means and driven to run along said transport path, each of said pair of chain means including a plurality of clamps for sequentially clamping the side edge of said film at a starting end portion of the chain means and sequentially releasing said side edge at a terminal end portion of the chain means, said pair of chain means being downwardly inclined from a position at a higher level than the upstream-side portion of said transport path of said transporting means and toward a position at a lower level than the downstream-side portion of said transport path whereby the film carried by said downwardly inclined chain means can be stretchably placed over the articles being packaged, means for supporting said pair of endless chain means, said supporting means including a pair of parallel side plates spaced apart transversely of said transport path and extending lengthwise of said pair of endless chain means, a machine frame having portions disposed adjacent said pair of side plates, and means for fixing said pair of side plates to said machine from portions in a selected one of a plurality of positions having different downward inclinations in accordance with the stretchability of said plastic film whereby the packaging apparatus is useable with each of a plurality of types of plastic film having different draw ratios.

2. A packaging apparatus as set forth in claim 1 further comprising:

means provided at the starting end side and at the terminal end side of the pair of the chain means for changing the distance between the pair of the chain means at the starting end side and at the terminal end side, and means for releasably interlocking said changing means at the starting end side and the changing means at the terminal end side with each other so that changeover is possible between a condition in which the distance between the pair of chain means is adjustable simultaneously at both the starting end side and the terminal end side and a condition in which the distance between the pair of the chain means is adjustable at either the starting end side or the terminal end side.

3. A packaging apparatus as set forth in claim 2 wherein said releasably interlocking means comprises:

a pair of means for driving said changing means at the starting and terminal end sides respectively, means for transmitting the drive force from one of said driving means to the other, and clutch means provided in said transmitting means.

4. A packaging apparatus as set forth in claim 1, further comprising rotatable roller means disposed at the downstream side of each of chain means, said roller means being spaced apart from each other and being inclined so that the upper ends thereof are positioned closer to each other and are tilted in the direction of the path of transport of packages, said roller means being adapted to contact both side edge portions of the film released from the pair of chain means thereby preventing said both said edge portions from being elastically shrunk.

5. A packaging apparatus as set forth in claim 1, wherein said cutting, folding, and adhesion means comprise:

a pair of side belt means for horizontally transporting an article being packaged after the step of tubular film cutting while holding the article therebetween, means for folding the leading end of the tubular film to the underside of the article, means including a multiplicity of first rollers mounted between a pair of first chains for catching the trailing end of the tubular film as they travel along the underside of an article carried between said side belt means and at higher speed than the side belt means, thereby folding said trailing end to the underside of the article, transfer conveyor means including a multiplicity of second rollers mounted between a pair of second chains for receiving from said side belts an article with which folding of the leading and trailing ends of the tubular film to the underside of the article has been completed, then transporting said article in a horizontal direction, belt conveyor means for receiving the article from said transfer conveyor means, then transporting same in a horizontal direction at a running speed different from or equal to the running speed of said side belts, said belt conveyor means incorporating a heater for heating the underside of the article and thermowelding the both end portions of the tubular film with which said folding has been completed to that portion of the film which corresponds to the underside of the article, and said second rollers being rotatable freely to prevent the film ends from coming off at the underside of the article when the article is transferred from said side belt means to said belt conveyor means.

6. A packaging apparatus as set forth in claim 5, wherein said transfer conveyor means are interlocked with the side belt means so that the transfer conveyor means are movable at a speed equal to that of the side belt means.

* * * * *

UNITED STATES PATENT AND TRADEMARK OFFICE

CERTIFICATE OF CORRECTION

PATENT NO. : 4,841,715

DATED : June 27, 1989

INVENTOR(S) : Tadoru Suga

It is certified that error appears in the above-identified patent and that said Letters Patent is hereby corrected as shown below:

Column 9, line 38 - "from" should read --frame--

Signed and Sealed this

Twenty-seventh Day of February, 1990

*Attest:*

JEFFREY M. SAMUELS

*Attesting Officer*

*Acting Commissioner of Patents and Trademarks*